US006959643B1

(12) United States Patent
Sammons et al.

(10) Patent No.: US 6,959,643 B1
(45) Date of Patent: Nov. 1, 2005

(54) HYDRAULIC TRASH COMPACTOR

(76) Inventors: Denise A. Sammons, 623 Chandon Ct., Southlake, TX (US) 76092; Ellis W. Sammons, 623 Chandon Ct., Southlake, TX (US) 76092

( * ) Notice: Subject to any disclaimer, the term of this patent is extended or adjusted under 35 U.S.C. 154(b) by 0 days.

(21) Appl. No.: 10/840,461

(22) Filed: May 7, 2004

(51) Int. Cl.[7] ..... B30B 15/00; B30B 1/36

(52) U.S. Cl. ..... 100/226; 100/229 A; 100/231; 100/266; 100/269.15; 100/269.18

(58) Field of Search ..... 100/214, 226, 100/229 R, 231, 229 A, 265, 266, 269.01, 100/270, 269.15, 269.18; 72/389.7; 60/482; 29/251, 252

(56) References Cited

U.S. PATENT DOCUMENTS 966,191 A * 8/1910 Gamewell et al. ..... 29/252
3,734,008 A 5/1973 Akerberg
4,050,373 A 9/1977 Hellmann
4,416,197 A 11/1983 Kehl
4,574,611 A * 3/1986 Hegemann ..... 72/389
4,682,539 A 7/1987 Bramblett et al.
D307,344 S * 4/1990 Massonnet ..... D34/7
5,619,915 A * 4/1997 Wagner et al. ..... 100/98 R
5,806,416 A 9/1998 Cerniglia et al.
6,305,278 B1 * 10/2001 Freeberg ..... 100/100
6,553,903 B2 * 4/2003 Hawkins ..... 100/269.17

* cited by examiner

*Primary Examiner*—Derris H. Banks
*Assistant Examiner*—Jimmy Nguyen

(57) ABSTRACT

A trash compactor includes a base member, an elongated stationary support member connected thereto, a mechanism for selectively compressing trash, and a hydraulic mechanism for operably controlling the compressing mechanism. The compressing mechanism includes a plurality of elongated telescopic tubes slidably engageable with each other wherein one of the plurality of tubes has a hollow interior and includes a helical spring member housed therein. The hydraulic mechanism includes a sump and a flexible conduit in fluid communication therewith, a manually operable pump connected upstream of the sump, and a valve connected to the pump for controlling the flow of fluid through the conduit.

9 Claims, 4 Drawing Sheets

HYDRAULIC TRASH COMPACTOR

CROSS REFERENCE TO RELATED APPLICATIONS

Not Applicable.

STATEMENT REGARDING FEDERALLY SPONSORED

RESEARCH OR DEVELOPMENT

Not Applicable.

REFERENCE TO A MICROFICHE APPENDIX

Not Applicable.

BACKGROUND OF THE INVENTION

1. Technical Field

This invention relates to waste disposal devices and, more particularly, to a hydraulic trash compactor for compacting household and commercial trash.

2. Prior Art

Many people now use bags for trash but cannot compress the trash very much without splitting the bag or tipping it over. These bags may be produced from paper or plastic as is the case when purchasing food when shopping.

Accordingly, it is common practice to locate relatively small waste receptacles in kitchens, bedrooms, offices or other places where waste collects at a rapid rate. These receptacles are preferably small and should be of an attractive character. Small receptacles are conventionally employed, but after the same have been in use for a short time, it becomes necessary for the depositor of the waste to follow the same into the receptacle with his hand to compress the contents thereof in order that more waste may be received thereby.

Obviously, this objectionable and even unsanitary practice should be obviated, and it is possible so to do through the employment of a compactor made in accordance with the present invention.

Accordingly, a need remains for a hydraulic trash compactor to reduce the size of trash being disposed.

BRIEF SUMMARY OF THE INVENTION

In view of the foregoing background, it is therefore an object of the present invention to provide an apparatus for compacting trash. These and other objects, features, and advantages of the invention are provided by a trash compactor including a base member having a bottom section provided with a substantially planar top surface extending along a horizontal plane and for receiving a trash receptacle thereon. The base member further has a lip portion extending upwardly from the bottom section and being spaced inwardly from a perimeter thereof so that a trash receptacle can be supported at a substantially stable position during operating conditions.

The trash compactor further includes an elongated stationary support member having integral lower and upper portions. The lower portion is secured to the base member and extends upwardly therefrom. The upper portion extends substantially orthogonally and outwardly from the lower portion and is aligned above the base member.

The trash compactor further includes a mechanism for selectively compressing trash contained within a receptacle wherein the compressing mechanism is connected to the upper portion of the support member and is operable along a substantially vertical plane between extended and retracted positions. The compressing mechanism includes a plate member having a substantially annular shape and formed from durable material for assisting an operator to compress trash to a desired shape.

The trash compactor further includes a hydraulic mechanism connected to the support member for selectively operating the compressing mechanism. The hydraulic mechanism includes a sump for housing a predetermined volume of fluid and a flexible conduit in fluid communication with the sump and extending outwardly therefrom to the compressing mechanism.

A manually operable pump is connected upstream of the sump and bifurcates the conduit so that fluid can be selectively extracted and directed to the compressing mechanism. The trash compactor further includes a handle pivotally connected to the pump for causing fluid to travel at a selected rate from the sump towards the compressing mechanism.

The compressing mechanism includes a plurality of elongated telescopic tubes slidably engageable with each other and having a common centrally disposed longitudinal axis. One of the plurality of tubes has a hollow interior and includes a helical spring member housed therein. The helical spring member has opposed end portions secured to the support member and the plate member respectively so that the plurality of telescopic tubes are caused to return to a retracted position after being moved downwardly to an extended position.

The plurality of tubes have respectively spaced outer surfaces for defining a gap therebetween and selectively receive fluid therein to thereby create a downward force for extending the plurality of tube. The plurality of tubes further include a plurality of O-rings spaced about a respective perimeter thereof for preventing fluid from leaking therefrom.

The compressing mechanism further includes a fitting having an aperture formed therein for channeling fluid from the conduit downwardly towards the plurality of tubes. The hydraulic mechanism further includes a valve connected to the pump selectively movable between open and closed positions for controlling the flow of fluid through the conduit so that the compressing mechanism can be maintained at an extended position during operating conditions.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
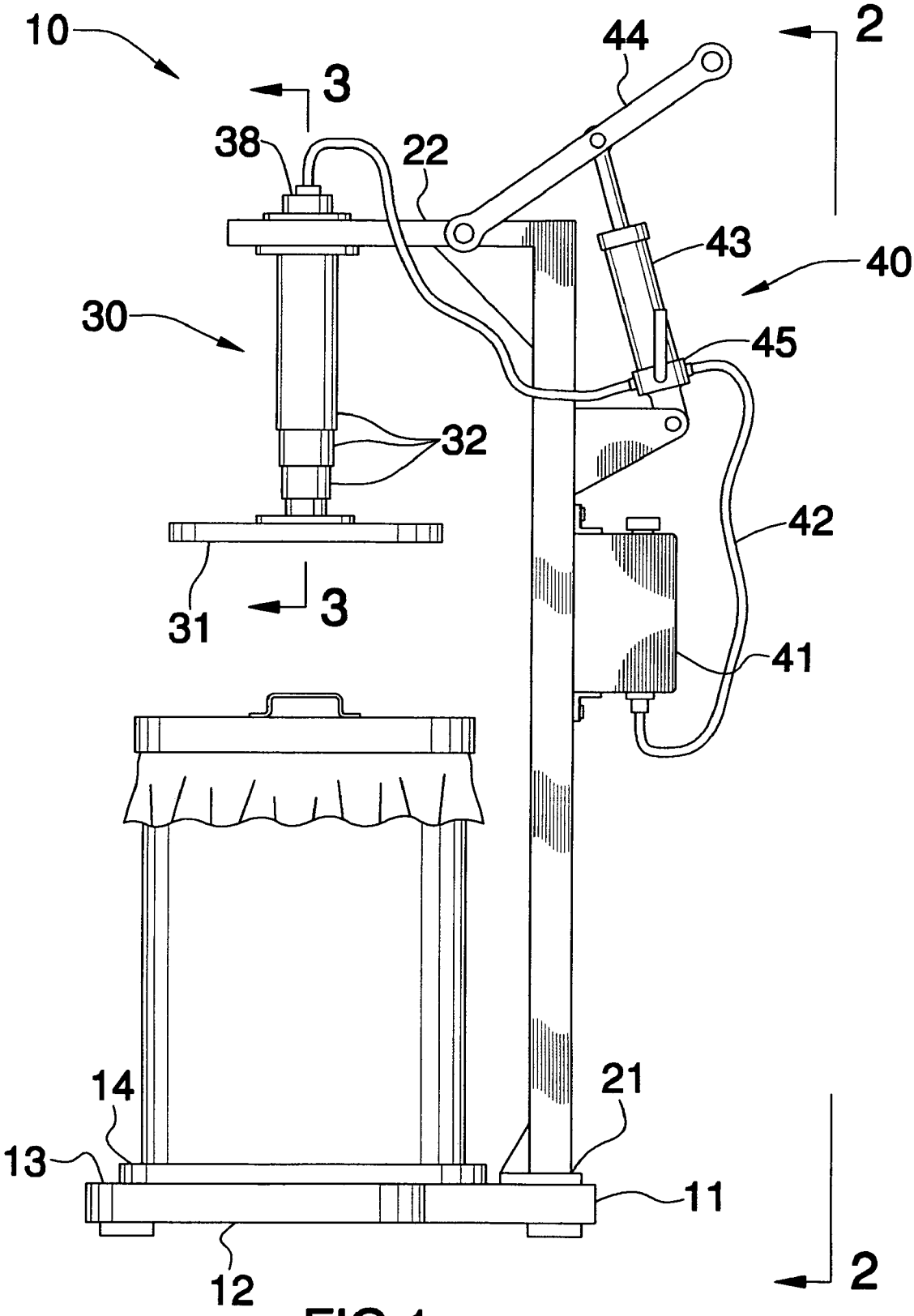
FIG. 1 is a side elevational view showing a hydraulic trash compactor, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–4 by the reference numeral 10 and is intended to provide a device for compacting trash. It should be understood that the trash compactor 10 may be used to compact many different types of objects and should not be limited to only compacting trash.

Figure 2:
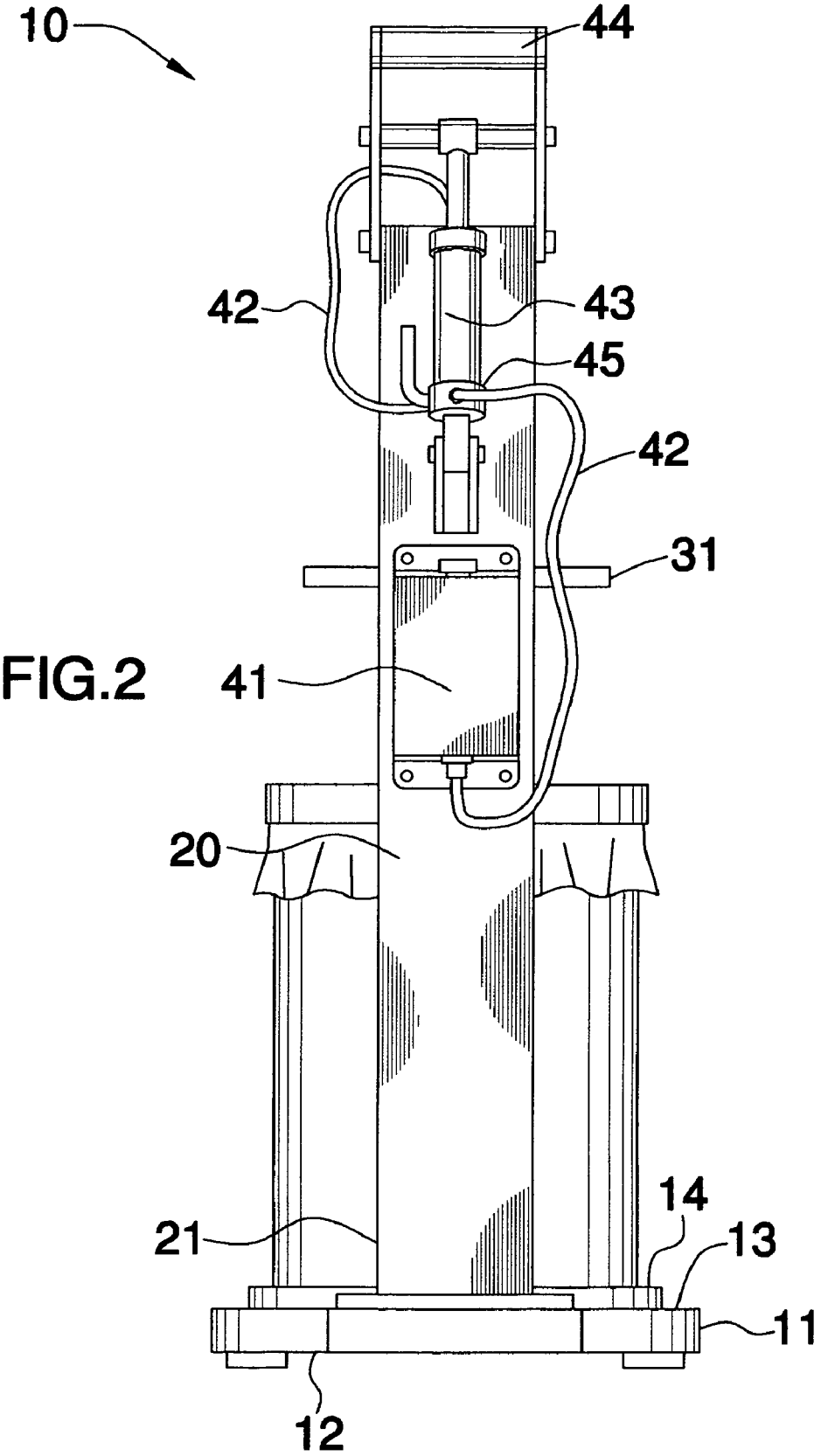
FIG. 2 is a cross-sectional view of the apparatus shown in FIG. 1, taken along line 2—2.

Initially referring to FIGS. 1 and 2, the trash compactor 10 includes a base member 11 having a bottom section 12 provided with a substantially planar top surface 13 extending along a horizontal plane and for receiving a trash receptacle thereon. The base member 11 further has a lip portion 14 extending upwardly from the bottom section 12 and being spaced inwardly from a perimeter thereof so that a trash receptacle can be supported at a substantially stable position during operating conditions. This prevents the trash receptacle from inadvertently being tipped over and spilling its contents prior to compaction of the trash.

The trash compactor 10 includes an elongated stationary support member 20 having integral lower 21 and upper 22 portions. The lower portion 21 is secured to the base member and extends upwardly therefrom. The upper portion 22 extends substantially orthogonally and outwardly from the lower portion 21 and is aligned above the base member 12.

Now referring back to FIG. 1, the trash compactor further includes a mechanism 30 for selectively compressing trash contained within a receptacle wherein the compressing mechanism 30 is connected to the upper portion 22 of the support member 20 and is operable along a substantially vertical plane between extended and retracted positions. The compressing mechanism 30 includes a plate member 31 having a substantially annular shape and formed from durable material for assisting an operator to compress trash to a desired shape. The annular shape of the plate member 31 enables the trash compactor 10 to fully compress all trash contained within a conventional trash receptacle having a similar size aperture as the plate member 31.

Now referring to FIGS. 1 and 2, the trash compactor 10 further includes a hydraulic mechanism 40 connected to the support member 20 for selectively operating the compressing mechanism 30. The hydraulic mechanism 40 includes a sump 41 for housing a predetermined volume of fluid and a flexible conduit 42 in fluid communication with the sump 41 and extending outwardly therefrom to the compressing mechanism 30.

A manually operable pump 43 is connected upstream of the sump 41 and bifurcates the conduit 42 so that fluid can be selectively extracted and directed to the compressing mechanism 30. The trash compactor 10 further includes a handle 44 pivotally connected to the pump 43 for causing fluid to travel at a selected rate from the sump 41 towards the compressing mechanism 30. This enables an operator to easily and selectively compact trash without the assistance of others.

Figure 3:
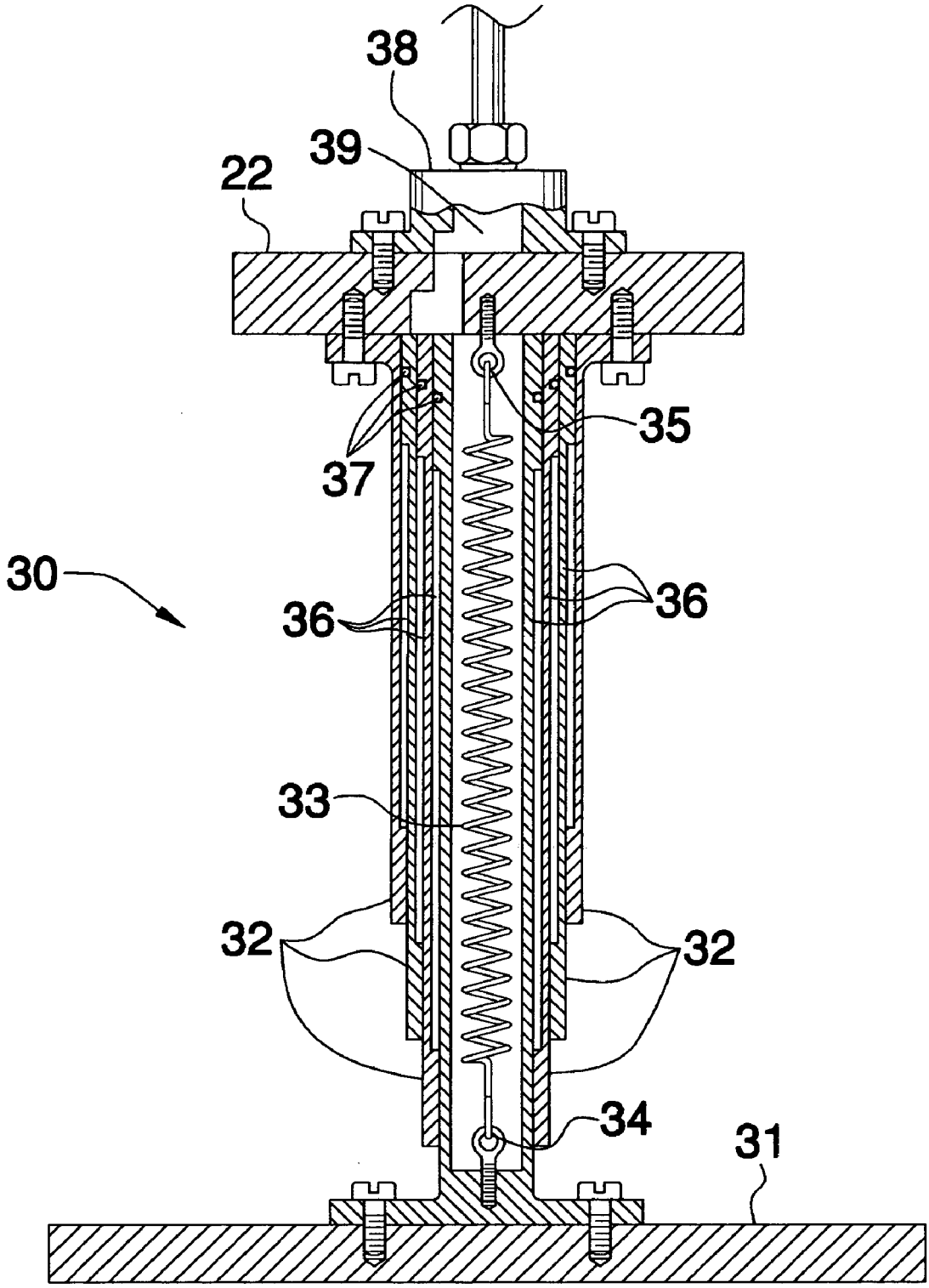
FIG. 3 is a cross-sectional view of the compressing mechanism, taken along line 3—3.
Figure 4:
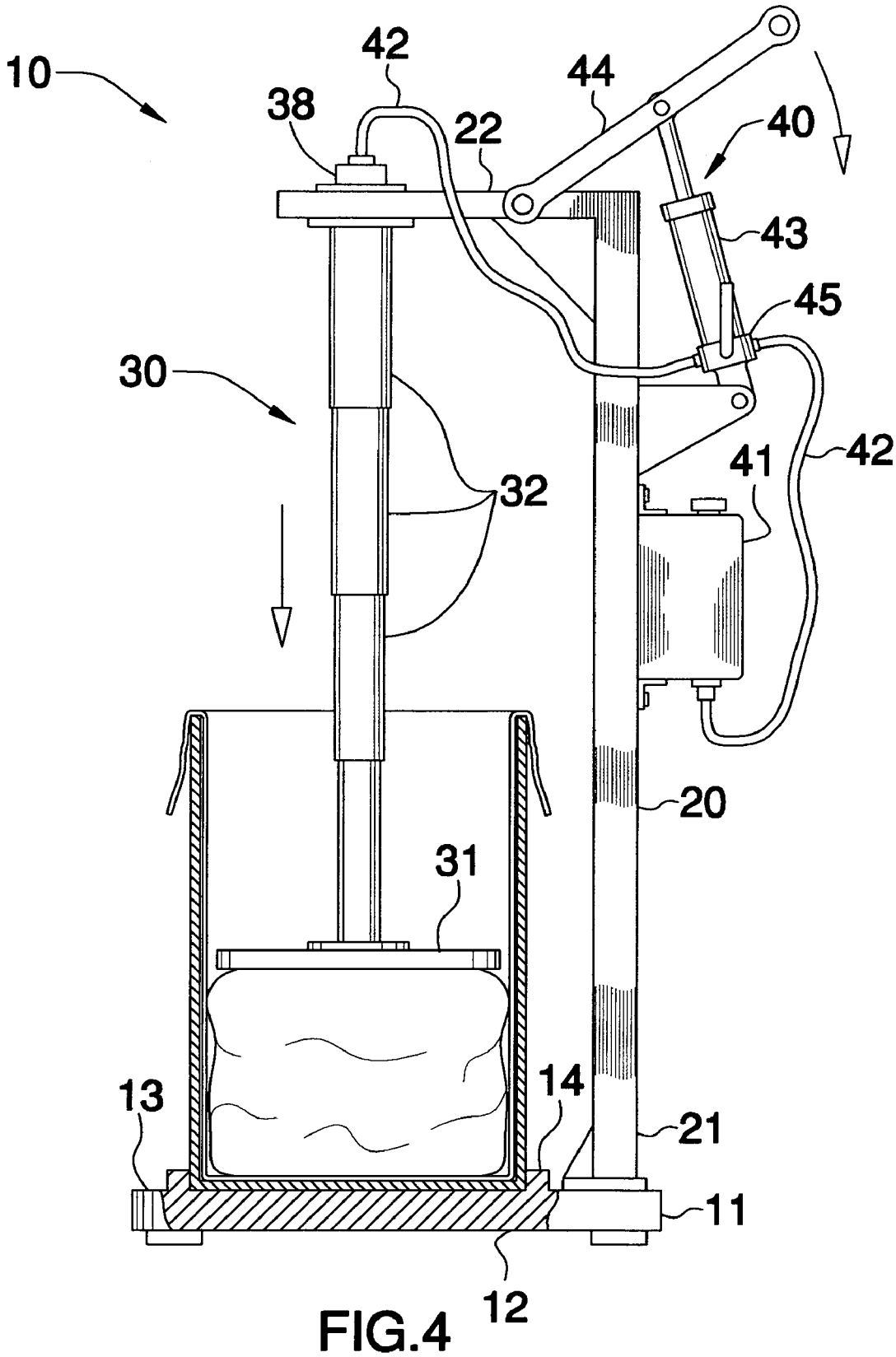
FIG. 4 is a partial cross-sectional view of the apparatus shown in FIG. 1 illustrating the compressing mechanism at an extended position.

Now referring to FIG. 4, the compressing mechanism 30 includes a plurality of elongated telescopic tubes 32 slidably engageable with each other and having a common centrally disposed longitudinal axis (not shown). One of the plurality of tubes 32 has a hollow interior and includes a helical spring member 33 housed therein, as shown in FIG. 3. The helical spring member 33 has opposed end portions 34, 35 secured to the support member 20 and the plate member 31 respectively so that the plurality of telescopic tubes 32 are caused to return to a retracted position as shown in FIG. 1, after being moved downwardly to an extended position as shown in FIG. 4.

The plurality of tubes 32 have respectively spaced outer surfaces 36 for defining a gap therebetween and selectively receive fluid therein to thereby create a downward force for extending the plurality of tubes 32, as shown in FIG. 3. When the plurality of tubes 32 are extended, any trash contained within a trash receptacle situated thereon is compressed. The plurality of tubes 32 further include a plurality of O-rings 37 spaced about a respective perimeter thereof for preventing fluid from leaking therefrom, as shown in FIG. 3.

Now referring back to FIG. 1, the compressing mechanism 30 further includes a fitting 38 having an aperture 39, as shown in FIG. 3, formed therein for channeling fluid from the conduit 42 downwardly towards the plurality of tubes 32. The hydraulic mechanism 40 further includes a valve 45 connected to the pump selectively movable between open and closed positions for controlling the flow of fluid through the conduit so that the compressing mechanism can be maintained at retracted or extended positions during operating conditions. This enables an operator to safely lock the plate member 31 at a selected position so that it does not injure an operator or other user who may reach into the trash receptacle to dislodge or remove items.

The trash compactor 10 is durable, safe, and easy to use. It provides a user with a quick and simple method of compacting trash, thereby saving time and space. The trash compactor 10 eliminates the necessity of stacking garbage bags in a garage or outside a residence where they are susceptible to animals and become an eyesore to neighbors. The trash compactor 10 also reduces the amount of space required for landfills, saving valuable resources.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed is:

1. A trash compactor comprising:

a base member including a bottom section provided with a substantially planar top surface extending along a horizontal plane and for receiving a trash receptacle thereon, said base member further having a lip portion extending upwardly from the bottom section and being spaced inwardly from a perimeter thereof so that a trash receptacle can be supported at a substantially stable position during operating conditions;

an elongated stationary support member having integral lower and upper portions, said lower portion being secured to said base member and extending upwardly therefrom, said upper portion extending substantially orthogonally and outwardly from said lower portion and being aligned above said base member;

means for selectively compressing trash contained within a receptacle wherein said compressing means is connected to said upper portion of said support member and is operable along a substantially vertical plane between extended and retracted positions, said compressing means comprising a plate member formed from durable material and for assisting an operator to compress trash to a desired shape, said compressing means comprising a plurality of elongated telescopic tubes slidably engageable with each other and having a common centrally disposed longitudinal axis, one said plurality of tubes having a hollow interior and comprising a helical spring member housed therein, said helical spring member having opposed end portions secured to said support member and said plate member respectively so that said plurality of telescopic tubes are caused to return to a retracted position after being moved downwardly to an extended position, said plurality of tubes having respectively spaced outer surfaces for defining a gap therebetween and selectively receive fluid therein to thereby create a downward force for extending the plurality of tubes:

hydraulic means connected to said support member and for selectively operating said compressing means, said hydraulic means comprising a sump for housing a predetermined volume of fluid, a flexible conduit in fluid communication with said sump and extending outwardly therefrom to said compressing means, a manually operable pump connected upstream of said sump and bifurcating said conduit so that fluid can be selectively extracted and directed to said compressing means, and a handle pivotally connected to said pump and for causing fluid to travel at a selected rate from said sump towards said compressing means.

2. The trash compactor of claim 1, wherein said compressing means further comprises:

a fitting having an aperture formed therein and for channeling fluid from said conduit downwardly towards said plurality of tubes.

3. The hydraulic trash compactor of claim 1, wherein said hydraulic means further comprises:

a valve connected to said pump and being selectively movable between open and closed positions for controlling the flow of fluid through said conduit so that said compressing means can be maintained at an extended position during operating conditions.

4. The trash compactor of claim 1, wherein said plurality of tubes further comprise:

a plurality of O-rings spaced about a respective perimeter thereof and for preventing fluid from leaking therefrom.

5. The trash compactor of claim 1, wherein said plate member has a substantially annular shape.

6. A trash compactor comprising:

a base member including a bottom section provided with a substantially planar top surface extending along a horizontal plane and for receiving a trash receptacle thereon, said base member further having a lip portion extending upwardly from the bottom section and being spaced inwardly from a perimeter thereof so that a trash receptacle can be supported at a substantially stable position during operating conditions;

an elongated stationary support member having integral lower and upper portions, said lower portion being secured to said base member and extending upwardly therefrom, said upper portion extending substantially orthogonally and outwardly from said lower portion and being aligned above said base member;

means for selectively compressing trash contained within a receptacle wherein said compressing means is connected to said upper portion of said support member and is operable along a substantially vertical plane between extended and retracted positions, said compressing means comprising a plate member formed from durable material and for assisting an operator to compress trash to a desired shape, said means comprising a plurality of elongated telescopic tubes slidably engageable with each other and having a common centrally disposed longitudinal axis, one said plurality of tubes having a hollow interior and comprising a helical spring member housed therein, said helical spring member having opposed end portions secured to said support member and said plate member respectively so that said plurality of telescopic tubes are caused to return to a retracted position after being moved downwardly to an extended position, said plurality of tubes having respectively spaced outer surfaces for defining a gap therebetween and selectively receive fluid therein to thereby create a downward force for extending the plurality of tubes, said compressing means further comprises a fitting having an aperture formed therein and for channeling fluid from said conduit downwardly towards said plurality of tubes;

hydraulic means connected to said support member and for selectively operating said compressing means, said hydraulic means comprising a sump for housing a predetermined volume of fluid, a flexible conduit in fluid communication with said sump and extending outwardly therefrom to said compressing means, a manually operable pump connected upstream of said sump and bifurcating said conduit so that fluid can be selectively extracted and directed to said compressing means, and a handle pivotally connected to said pump and for causing fluid to travel at a selected rate from said sump towards said compressing means.

7. The hydraulic trash compactor of claim 6, wherein said hydraulic means further comprises:

a valve connected to said pump and being selectively movable between open and closed positions for controlling the flow of fluid through said conduit so that said compressing means can be maintained at an extended position during operating conditions.

8. The trash compactor of claim 6, wherein said plurality of tubes further comprise:

a plurality of O-rings spaced about a respective perimeter thereof and for preventing fluid from leaking therefrom.

9. The trash compactor of claim 6, wherein said plate member has a substantially annular shape.

* * * * *